United States Patent [19]

Richter et al.

[11] 4,233,110

[45] Nov. 11, 1980

[54] PROCESS FOR ETCHING AND PREPARING NICKEL-POLYESTER OFFSET PRINTING PLATES

[75] Inventors: Siegfried Richter, Fullinsdorf; Josef Vinkovic, Kreuzlingen, both of Switzerland

[73] Assignee: Swiss Aluminum Ltd., Chippis, Switzerland

[21] Appl. No.: 23,448

[22] Filed: Mar. 23, 1979

Related U.S. Application Data

[63] Continuation-in-part of Ser. No. 846,329, Oct. 23, 1977, abandoned.

[30] Foreign Application Priority Data

Oct. 29, 1976 [CH] Switzerland ..... 13648

[51] Int. Cl.[2] ..... B41C 1/00; B41N 3/02

[52] U.S. Cl. ..... 156/656; 101/465; 101/466; 156/659.1; 156/664; 156/905; 430/302; 430/310

[58] Field of Search ..... 156/656, 659, 664, 666, 156/905, 79.1, 79.4; 96/36.3, 33; 106/2, 14.05, 14.11, 14.13, 14.14, 14.21; 101/465, 466

[56] References Cited

U.S. PATENT DOCUMENTS

| | | | |
|---|---|---|---|
| 2,684,892 | 7/1954 | Saulnier | 156/666 |
| 2,940,837 | 6/1960 | Acker et al. | 156/664 |
| 3,033,725 | 5/1962 | Daugherty et al. | 156/666 |
| 3,136,670 | 6/1964 | Rogers et al. | 252/79.4 |
| 3,144,368 | 8/1964 | Daugherty et al. | 156/666 |
| 3,148,100 | 9/1964 | Elston | 156/666 |
| 3,152,083 | 10/1964 | Croisant et al. | 252/79.4 |
| 3,161,552 | 12/1964 | Bradley et al. | 156/666 |
| 3,232,802 | 2/1966 | Young et al. | 156/664 |
| 3,239,466 | 3/1966 | Hoornstra | 156/664 |
| 3,293,186 | 12/1966 | Chu et al. | 101/466 |
| 3,330,765 | 7/1965 | Hoornstra | 252/79.4 |
| 3,402,083 | 9/1968 | Patsko et al. | 156/664 |
| 3,458,372 | 7/1969 | Borth et al. | 252/79.4 |
| 3,514,408 | 5/1970 | Borth et al. | 252/79.3 |
| 3,514,409 | 5/1970 | Borth et al. | 252/79.3 |
| 3,544,319 | 12/1970 | Diebold et al. | 96/36.3 |
| 3,672,885 | 6/1972 | Ort | 101/465 |
| 3,698,904 | 10/1972 | Fukui et al. | 101/466 |
| 3,761,331 | 9/1973 | McCanahan et al. | 156/665 |
| 3,829,319 | 8/1974 | Suzuki et al. | 106/2 |
| 3,931,030 | 1/1976 | Ohno | 156/664 |
| 4,116,698 | 9/1978 | Machida et al. | 106/2 |

FOREIGN PATENT DOCUMENTS

| | | | |
|---|---|---|---|
| 1571903 | 12/1970 | Fed. Rep. of Germany . | |
| 48-12926 | 4/1973 | Japan | 101/465 |

*Primary Examiner*—Jerome W. Massie
*Attorney, Agent, or Firm*—Fisher, Christen & Sabol

[57] ABSTRACT

Process for etching a nickel-polyester layered offset plate, which is made by electroless nickel-plating of polyester and subsequently coated on the nickel-layer by a photoresist layer. After exposure of the photoresist layer under a transparent master and development of the offset-plate, the offset-plate is etched by an aqueous etching solution containing copper(II) ions, as the only etching agent together with $Cl^-$ ions. An offset printing plate is prepared from the etched nickel-polyester layered plate. The nickel layer of the nickel-polyester layered plate is etched with the aqueous etching solution. The etching solution additionally contains:

(a) a salt which is inert as against the nickel-polyester layered plate, or 10 to 40 weight percent of an organic solvent, which is miscible or nonmiscible with water and which is inert as against the nickel-polyester layered plate, and 60 to 90 weight percent of de-ionized water; and (b) a wetting agent or pyridine.

Subsequent to the etching process, the photoresist is removed and the printing parts (i.e., polyester parts) of the nickel-polyester layered plate are oleophilized with an oleophilization agent which is an aliphatic acid, aromatic acid, acid chloride or acid anhydride. The non-etched portion of the nickel layer of the nickel-polyester layered plate is hydrophilized with a solution of a complexing agent for nickel ions, which opposite the solvating sphere of the nickel complex has only hydrophilic groups. The oleophilization of the polyester layer and hydrophilization of the nickel layer can be executed separately in two process steps or executed concurrently in one process step, using one solution containing the oleophilization agent and the complexing agent. The aqueous etching solution does not contain a side-wall protective additive.

10 Claims, No Drawings

PROCESS FOR ETCHING AND PREPARING NICKEL-POLYESTER OFFSET PRINTING PLATES

This is a continuation-in-part of U.S. application Ser. No. 846,329, filed on Oct. 23, 1977, now abandoned.

BACKGROUND OF THIS INVENTION

1. Field of this Invention

This invention relates to a process for etching and preparing offset plates.

2. Prior Art

German OS NO. 1,571,903 discloses etching multilayered offset printing plates, which consist of a carrier and at least one metal layer on it (preferably a nickel layer), with ferric chloride and copper chloride and a small addition of acid. The metal layer may be etched right through to the carrier, for example, a plastic base. In said German OS, the plastic base is said to be oleophilic without special treatment, so the printing element should need no further treatment.

From the etching of offset printing plates (produced by electroless nickel-plating of a plastic foil and then were coated with a photoresist-layer, exposed and developed), it turned out that the etching solutions described in German OS No. 1,571,903 had the following disadvantages.

When the etching medium concentration is too high, the etching solutions ($FeCl_3$, $CuCl_2$) act too aggressively (i.e., etching times are too short). Whenever the concentration of the etching medium is reduced to a point that the etching time are long enough, the etching capacity of the etching solution is insufficient to etch the nickel layer when etching is carried out by hand using only small amounts of solution.

As a result of poor wetting, the nickel layer is etched irregularly.

At the points protected by the photolayer, an underetching takes place when etching with $FeCl_3$ solution or $FeCl_3/CuCl_2$ solutions. Such underetching has the consequence that nickel-dots are partly finer than intended or even the consequence of the complete etching away of fine nickel points.

Whenever a polyester foil (nickel coated according to the electroless plating process), which has been etched photomechanically, is inked directly with printing ink without first treating it in some way, one finds that both the nickel layer as well as the polyester layer take up the ink—the adsorption of the ink by the polyester layer is still capable of improvement, i.e., in the printing machine, the oleophilic polyester parts of the plate show insufficient adsorption of ink and the hydrophilic nickel-parts show adsorption of the ink.

See also: U.S. Pat. No. 3,931,030; U.S. Pat. No. 3,136,670; U.S. Pat. No. 3,293,186; U.S. Pat. No. 3,239,466; U.S. Pat. No. 3,232,802; U.S. Pat. No. 3,672,885; U.S. Pat. No. 3,458,372; and Japanese Pat. No. 7,312,926.

BROAD DESCRIPTION OF THIS INVENTION

An object of this invention is to provide a process for etching and preparing offset printing plates which do not possess the above-stated disadvantages of the prior art. Other objects and advantages of this invention are set out herein or are obvious herefrom to one ordinarily skilled in the pertinent art.

The objects and advantages of this invention are achieved by the process of this invention.

It was found that the above-specified known disadvantages of the prior art are avoided if the offset printing plate is etched with an aqueous solution, which additionally contains:

(a) a salt which is inert vis-a-vis the layer system of the offset printing plate to be treated, or a water-miscible or nonmiscible organic solvent which is inert vis-a-vis the layer system of the offset printing plate to be treated;

(b) a wetting agent or pyridine, and (c) a side wall protective additive which reacts with the products of the etching reaction to form insoluble salts or complexes.

Subsequent to the etching process, the photoresist is removed from the plate and the printing parts (i.e., polyester parts) of the plate surface are oleophilized with an aliphatic acid, aromatic acid, acid chloride or acid anhydride. The metal layer is hydrophilized with a solution of a complexing agent for nickel ions, which has hydrophilic groups vis-a-vis the solvate sphere of the nickel complex. The oleophilization of the plastic layer and the hydrophilization of the metal layer can be carried out with the same solution in one operating step.

Preferably, a nickel-polyester offset printing plate is used as a offset printing plate on a metal-polyester base. According to this invention, one uses an etching solution which on the one hand has a sufficiently high concentration of ferric or copper salts, so that the etching capacity of the solution will suffice for etching a 1 to 2 μm thick nickel layer, and on the other hand the etching time is freely adjustable within wide limits. This is achieved by adding an inert salt or organic solvent in sufficient concentration to an aqueous solution having a sufficiently high $Fe^{3+}$ and/or $Cu^{2+}$ ion concentration, usually in the range of $5\times10^{-2}$ to 2 moles per liter. As a result of the concentration of such added substances, the etching time for nickel layers of a certain thickness is adjustable. Whenever organic substances which are not miscible with water are used, then by the aid of emulisifiers, etching-emulsion may be produced which are likewise suitable for the manual etching process.

Preferably the same substances are used as emulsifiers, which are listed below as wetting agents.

In inert salt can be, for example, a water-soluble chloride, sulfate, borate or fluoroborate of a metal ion of Group Ia or IIa, or of the ion $NH_4^+$, $Z_n^{2+}$ or $Al^{3+}$. Examples of suitable salts are sodium sulfate, potassium borate, calcium chloride, zinc chloride, magnesium sulfate, etc. Preferably a concentration of 10 gm per liter up to the maximal solubility of the salt is used in the etching solution, depending on the desired etching speed. The organic solvent, for example, can be a monofunctional alcohol, a multifunctional alcohol, a ketone, an aldehyde, an ester, a substituted aromatic or unsubstituted aromatic. Examples of suitable organic solvents are ethanol, glycerin, toluene, ethyl acetate, turpentine, decalin, cyclohexane, isopropanol, etc.

However, in the selection of the organic solvent care must be taken that the organic solvent does not dissolve the photoresist layer.

The wetting of the nickel layer, that is to be etched, with the etching solution is considerably increased by the addition of a wetting agent, an alcohol or pyridine to the etching solution. Preferably the wetting agents is an alkylsulfate, an alkyarylsulfonate, a soap or an alkylammonium salt. The wetting agent is used preferably in a concentration of 0.1 to 1 gm per liter of etching solution.

In the case of etching solutions, wherein the etching component consists exclusively of $CuCl_2$, no addition of chemicals is required in order to avoid underetching. The Cu (I) salts, which are formed during the etching process and which are insoluble in the etching solution, produce sufficient side-wall protection of the pressure points.

In the case of etching solutions based on $FeCl_3$, it was found that the underetching of the nickel points may be reduced considerably by the addition of certain chemicals. Chemicals, which are suitable for such objective, are these which react with the products of the etching reaction to produce salts, complexes, etc., that are insoluble in the etching solution, under the etching conditions.

The disodium salt of dimethylglyoxine or $K_3[Fe(CN)_6]$ is preferably used as the side-wall protection additive for etching solutions based on $FeCl_3$. The quantative ratio is about 1 to 50 gm per liter of etching solution.

After etching and removal of the photoresist layer, the oleophilicity of the polyester layer is increased by treatment of the plate surface with a suitable aliphatic acid, aromatic acid, an acid chloride or anhydride, in such a way that perfect printing is assured. The plastic layers are preferably treated with concentrated acetic acid, lauric acid, lauric acid chloride, phenyl acetychloride or benzoic acid anhydride in a solvent, such as DMF (i.e., dimethyl formamide), so that at least partial esterification of the polyester surface (saponified prior to metal coating) takes place during this pre-treatment. If the printing plate (treated in that way) is inked up with printing ink, by hand, then oleophilic polyester parts of the plate show a good absorption of ink. Good absorption of ink by the oleophilic polyester-parts of the plate also takes place in the printing machine. Treatment can be by immersion or wiping the solution onto the surface of the plate.

Sufficient hydrophilicity of the nickel layer for the printing process is likewise achieved by means of a simple treatment of the nickel layer with a solution of certain substances. The metal layer is hydrophilized with a solution of a complexing agent for nickel ions. As complexing agents for hydrophilizing nickel surfaces, only such complexing agents are suitable which form Ni-complexes with hydrophilizing groups vis-a-vis the solvating sphere of the complexes. Suitable hydrophilization complexing agents are, for example, citric acid, ascorbic acid, $K_3[Fe(CN)_6]$, $K_4[Fe(CN_6)]$, and $OH^-$ from an alkaline solution having a pH value of 9 or higher.

By combination of the chemical oleophilization agent for the polyester and the chemical hydrophilization agent for nickel into one solution, the two treatment steps can be combined into one step.

The oleophilization preparation of the polyester and the hydrophilization of the nickel layers must be accomplished immediately following the removal of the photoresist layer from the printing plate. The preparation of the printing-plate is completed by the application of a commercial, water-soluble colloidal protective layer. Shortly before the beginning of printing process, the protective layer of colloid is washed away.

When this conservation with the protection colloid layer is not accomplished, or is insufficiently done, the nonprinting nickel-areas of the plate show a scumming effect during the printing-process. In this case the treatment of the polyester and/or nickel prior to the beginning of printing can be done during a stop of the printing machine.

To reiterate, this invention involves a process for etching a nickel-polyester layered offset-plate, which is made by electrodes nickel-plating of polyester and subsequently coating of the nickel-layer by a photoresist layer. After exposure of the photoresist layer under a transparent master and development of the offset-plate, the offset-plate is etched by an etching solution containing iron (III) and/or copper II ions [except for copper (II) ions together with $Cl^-$ ions in the case of (c)], and preparing an offset printing plate on a nickel-layered plate. The nickel-polyester layered plate is etched with an aqueous etching solution. The etching solution additionally contains:

(a) a salt which is inert as against the nickel-polyester layered plate, or an organic solvent miscible or nonmiscible with water and which is inert as against the nickel-polyester layered plate;
(b) a wetting agent or pyridine; and
(c) a side-wall protective additive which reacts with the products of the etching reaction to produce insoluble salts or complexes.

Subsequent to the etching process, the photoresist is removed from the plate and the printing parts (i.e., polyester parts) of the plate surface are oleophilized with an aliphatic acid, aromatic acid, acid chloride or acid anhydride. The metal layer is hydrophilized with a solution of a complexing agent for nickel ions, which in the solvating sphere of the nickel complexes has hydrophilic groups. The oleophilization of the polyester parts and the hydrophilization of the nickel-parts of the plate may be executed concurrently in one process step using one solution containing both agents.

DETAILED DESCRIPTION OF THIS INVENTION

As used herein, all parts, percentages and ratios are on a weight basis unless otherwise stated herein or otherwise obvious herefrom to one ordinarily skilled in the pertinent art.

EXAMPLE 1

A polyester foil provided with a 2 μm thick nickel layer (using the electroless plating process) is coated with diazophoto resist lacquer and exposed under a negative master-transparent. The photolayer is developed. All of the examples are carried out at room temperature. All of the following examples start with a portion of the foil prepared in Example 1.

EXAMPLE 2

A portion of the foil (prepared in Example 1) is dipped into a 20 percent solution of $FeCl_3.6H_2O$ in water ($7.4\times10^{-1}$ molar). After 2.5 minutes the etching process is completed. After the removal of the photoresist layer, a strong reduction and underetching of the nickel points is found.

EXAMPLE 3

Another portion of the foil prepared in Example 1 is dipped for etching into a solution of 20 percent of $CuCl_2.2H_2O$ in water (1.2 molar). The etching process is completed after 3 minutes. After removal of the photoresist layer, no reduction and underetching of the nickel points is found. The decrease of the copper chloride concentration in the etching solution to 10 percent results in an extension of the etching time to 5 minutes and a certain reduction of the nickel points.

EXAMPLE 4

Another etching test is carried out with a solution, containing 10 percent of $CuCl_2.2H_2O$ and 5 percent $FeCl_3.6H_2O$ in water, on a portion of the foil (prepared in Example 1). The etching process is completed after 2 minutes, but a very strong underetching is observed.

EXAMPLE 5

To reduce the etching speed 100, 200, 300 and 400 gm of $CaCl_2.2H_2O$ are each added to one liter of a 20 percent $FeCl_3.6H_2O$ solution in water (see Example 2). Each solution is used to etch a portion of the foil prepared in Example 1. As a result, the etching times are increased from 2 minutes to 2.5, 3.0, 3.5 and 4 minutes, respectively. The underetching and reduction of the pressure points are not essentially influenced by such additions of $CaCl_2.H_2O$.

EXAMPLE 6

Four 20 percent solutions of $CuCl_2.2H_2O$ are made, containing 10, 20, 30 and 40 percent of glycerin (the remainder being de-ionized water). Each solution is used to etch a portion of the foil prepared in Example 1. With such solutions, etching times of 3.5, 4.0, 4.75 and 5.5 minutes, respectively, are observed.

EXAMPLE 7

A solution containing, in 1 liter of water, 100 gm of $CuCl_2.2H_2O$, 100 gm of $FeCl_3.6H_2O$ and 200 gm of $ZnSO_4.7H_2O$ results in etching times of 5 to 5.5 minutes when etching a portion of the nickel foil (preparing in Example 1) by dipping the foil into the solution. In the case of etching by wiping the etching solution onto the printing plate by a pad, a poor wetting of the prepared surface of the plate is observed. Whenever 0.1 gm per liter of the sodium salt of 4-chlorine-3,5-dinitrobenzolsulfonic acid is added to the solution as wetting agent, in the case of etching by dipping the foil into the etching solution, a reduction of the etching time to 4 to 4.5 minutes is found. Also, when etching is carried out by the wiping of method, an essential improvement of the wetting of the surface of the plate is observed.

EXAMPLE 8

An etching solution containing, in 1 liter of water, 100 gm of $FeCl_3.6H_2O$ and 200 gm of glycerin is used to treat a portion of the foil (prepared in Example 1)—the etching process is completed in about 5.5 minutes. A strong reduction and underetching of the nickel points is found. Whenever the disodium salt of dimethylglyoxine in a concentration of 1 percent is added to the solution, then considerably less underetching and reduction of the nickel points results and the etching time is extended to 6 minutes.

EXAMPLE 9

Instead of the disodium salt of dimethylglyoxine, potassium hexacyanoferrate-(III) in a concentration of 1 percent is added to the etching solution described in Example 8. There is a decrease of the underetching and reduction of the pressure points and an extension of the etching time to 8 minutes.

EXAMPLE 10

A nickel-polyester printing plate produced according to the electroless Ni-plating process provided with a photoresist layer is exposed below a suitable transparent master, developed and etched and the photoresist layer is removed. During the subsequent printing process it turns out that both the nickel as well as the polyester surface-areas of the plate take the printing ink, however, the ink adsorption of the polyester as the oleophilic element of the printing plate is insufficient. Whenever the printing ink is removed from the plate and the latter is treated with glacial acetic acid, [for example, the treatment may be by wiping on the solution with a pad, (1 to 2 minutes) or dipping the foil into the solution (1 minute)], with a new printing trial, there is considerably improved ink adsorption of the oleophilic polyester elements of the offset printing.

EXAMPLE 11

A nickel-polyester offset printing plate, etched and delayered as described in Example 10, is hydrophilized immediately after preparation with a solution of 100 grams per liter of $Na_3PO_4.12H_2O$ in water for 1 minute by dabbing. Subsequently the plate is washed well and a 10 percent solution of benzoic acid anhydride in DMF is wiped on for 1 minute. Subsequently the plate is washed intensively with water, after which the printing plate is immediately used for printing or is provided with a protective colloid layer until the beginning of the printing process. During the printing process, the nickel-surface areas of the plate are perfectly hydrophilic and the exposed polyester surface areas of the plate are oleophilic.

EXAMPLE 12

A solution (1 liter) containing 50 gm of lauric acid and 50 gm of citric acid in DMF is wiped for 1 minute onto an etched and delayered nickel-polyester offset printing plate, immediately after the removal of the photoresist (delayering). Subsequently, the plate is washed well with water. Both during inking up of the plate as well as in the printing machine, good separation of and water is obtained on the surface of the plate.

What is claimed is:

1. Process for etching a nickel-polyester layered offset plate, which is made by electroless nickel-plating of polyester and subsequently coated on the nickel-layer by a photoresist layer, after exposure of the photoresist layer under a transparent master and development of the offset-plate, the offset-plate is etched by an aqueous etching solution containing copper (II) ions, as the only etching agent, together with $Cl^-$ ions and preparation of an offset printing plate from said etched nickelpolyester layered plate, characterized in that:

(1) said nickel layer of said nickel-polyester layered plate is etched with said aqueous etching solution, said etching solution additionally containing:

(a) a salt which is inert as against said nickel-polyester layered plate, or 10 to 40 weight percent of an organic solvent, which is miscible or nonmiscible with water and which is inert as against said nickel-polyester layered plate, and 60 to 90 weight percent of de-ionized water; and (b) a wetting agent or pyridine;

(ii) subsequent to the etching process, the photoresist is removed and the printing parts of the polyester of said nickel-polyester layered plate are oleophilized with an oleophilization agent which is an aliphatic acid, aromatic acid, acid chloride or acid anhydride; and (iii) the non-etched portion of said layer of nickel of said nickel-polyester layered plate is hydrophilized with a solution of a complexing agent for nickel ions, which opposite the solvating sphere of the nickel complex has only hydrophilic groups, said oleophilization of said polyester layer and hydrophilization of said nickel layer being executed separately in different process steps or executed concurrently in one process step using one solution containing said oleophilization agent and said complexing agent, and said aqueous etching solution not containing a sidewall protective additive.

2. Process as claimed in claim 1, wherein said salt, which is inert against the layer to be treated, is a water soluble chloride, sulfate, borate or fluoroborates of a metal ion of Group Ia or IIa metals or of $NH_4^+$, $Zn^{2+}$ and $Al^{3+}$.

3. Process as claimed in claim 2 wherein said salt is sodium sulfate, potassium sulfate, magnesium sulfate, calcium chloride or zinc chloride.

4. Process as claimed in claim 1 wherein said water-miscible or water-nonmiscible organic solvent, which is inert against the layer to be treated, is a mono- or multifunctional alcohol, ketone, aldehyde, ester or a substituted or unsubstituted aromatic.

5. Process as claimed in claim 4 wherein said organic solvent is ethanol, glycerin, toluene, ethyl acetate, turpentine, decalin, cyclohexane or isopropanol.

6. Process as claimed in claim 1 wherein said wetting agent is an alkyl sulfate, an alkylarylsulfonate, a soap or an alkyl ammonium salt.

7. Process as claimed in claim 6 wherein said wetting agent is present in an amount between 0.1 and 1 gram per liter of said etching solution.

8. Process as claimed in claim 1 wherein said layer of polyester is oleophilized with concentrated acetic acid, concentrated lauric acid, concentrated lauric acid chloride, concentrated phenylacetyl chloride or benzoic acid anhydride in dimethyl formamide.

9. Process as claimed in claim 1 wherein said nickel layer is treated with a hydrophilization complexing agent for nickel ions, which in the solvating sphere of the formed nickel complexes has hydrophilic groups, said complexing agent being citric acid, ascorbic acid, $K_3[Fe(CN)_6]$, $K_4[Fe(CN)_6]$ or $OH^-$ of an alkaline solution having a pH value of 9 or higher.

10. Process as claimed in claim 1 wherein the agent for chemically oleophilizing said polyester and said hydrophilization complexing agent for chemically hydrophilizing said nickel are present in one solution.

* * * * *